US005900567A

United States Patent [19]

Fay et al.

[11] Patent Number: 5,900,567

[45] Date of Patent: May 4, 1999

[54] SYSTEM AND METHOD FOR ENHANCING MUSICAL PERFORMANCES IN COMPUTER BASED MUSICAL DEVICES

[75] Inventors: Todor C. Fay, Bellevue; David G. Yackley, Redmond, both of Wash.

[73] Assignee: Microsoft Corporation, Redmond, Wash.

[21] Appl. No.: 08/880,883

[22] Filed: Jun. 23, 1997

[51] Int. Cl.[6] ..... G10H 1/38

[52] U.S. Cl. ..... 84/613; 84/609; 84/619; 84/637; 84/649; 84/657

[58] Field of Search ..... 84/609–613, 615–616, 84/619, 634–637, 649–652, 653–655, 657, 666–669

[56] References Cited

U.S. PATENT DOCUMENTS 5,220,122 6/1993 Shibukawa ..... 84/669

*Primary Examiner*—William M. Shoop, Jr.
*Assistant Examiner*—Marlon T. Fletcher
*Attorney, Agent, or Firm*—Jones & Askew

[57] ABSTRACT

A system and a method for the notes of one track to move in a harmonically separate manner from the notes of another track when the notes of each track are played against a chord progression. Each track is associated with a chord function. The notes of the tracks are then played against a progression of polychords, where each polychord consists of one or more chords. In addition, each chord of a polychord is associated with one or more chord functions. During operation, each note of a track is mapped against a chord of the currently playing polychord. The chord for each track is selected by identifying the chord of the polychord that is associated with the same chord function as the track. Furthermore, individual tracks, groups of notes, or single notes can be assigned to one of several playback modes. Each note includes a field that identifies a playback mode. In addition, each track is associated with a playback mode. Prior to generating a performance note, the playback mode for the note is determined, and the note is transposed or mapped against the currently playing chord in accordance with the playback mode.

33 Claims, 7 Drawing Sheets

SYSTEM AND METHOD FOR ENHANCING MUSICAL PERFORMANCES IN COMPUTER BASED MUSICAL DEVICES

RELATED APPLICATIONS

U.S. patent application Ser. No. 08/384,668, filed Feb. 6, 1995 entitled "Music Composition System for Enhancing a Multimedia Presentation", filed on and assigned to Microsoft Corporation of Redmond, Wash., the assignee of the present application, is incorporated herein by reference. Application Ser. No. 08/384,668 discloses an exemplary embodiment of a music composition system that can serve as an operational environment for the present invention.

TECHNICAL FIELD

The present invention relates to computer-based music performance devices and, more particularly, relates to enhancing the capabilities of a music performance device for transposing musical notes against chord progressions.

BACKGROUND OF THE INVENTION

Context-sensitive musical performances have become a key component of electronic and multimedia products such as stand-alone video games, computer based video games, computer based slide show presentations, computer animation, and other similar products and applications. As a result, music generating devices and/or music playback devices have been more highly integrated into electronic and multimedia products.

Previously, musical accompaniment for multimedia products was provided in the form of pre-recorded music that could be retrieved and performed under various circumstances. Using pre-recorded music for providing context-sensitive musical performances has several disadvantages. One disadvantage is that the pre-recorded music requires a substantial amount of memory storage. Another disadvantage is that the variety of music that can be provided using this approach is limited due to memory constraints. Thus, the musical accompaniment for multimedia devices utilizing this approach is wasteful of memory resources and can be very repetitious.

Today, music generating devices are directly integrated into electronic and multimedia products for composing and providing context-sensitive, musical performances. These musical performances can be dynamically generated in response to various input parameters, real-time events, and conditions. For instance, in a graphically based adventure game, the background music can change from a happy, upbeat sound to a dark, eerie sound in response to a user entering into a cave, a basement, or some other generally mystical area. Thus, a user can experience the sensation of live musical accompaniment as he engages in a multimedia experience.

U.S. patent application Ser. No. 08/384,668 entitled "Music Composition System for Enhancing a Multimedia Presentation" discloses a music generating device that can be integrated into multimedia products. FIG. 1 is a block diagram of a system incorporating this music generating device. In general, the system includes a composing component, a performance component, a musical instrument interface component and a control component. The system in FIG. 1 illustrates the composing component as a composition engine 14, the performance component as a performance engine 16, the instrument interface component as an MIDI interface 39, and the control component as an arbitrator 12 interacting with an application program 36 and data storage 27. The application program 36 operates to control a multimedia presentation such as a video game or a slide show presentation.

During the multimedia presentation, the arbitrator 12 receives from the application program 36, input parameters and information that can be interpreted for selecting or modifying the shape, style and personality of the musical performance. Based on the interpretation of this information, the arbitrator 12 may access data storage 27 to obtain musical sections and styles (to be defined following) to be passed to performance engine 16. Alternatively, the arbitrator 12 can pass composition parameters to composition engine 14. In response, the composition engine 14 composes musical sections and passes them to performance engine 16 for being performed or to arbitrator 12 for storage.

The performance engine 16 receives musical sections and musical styles as inputs. A musical style contains a series of time-stamped musical data including musical notes, with each note being associated with a specific track or channel number. The time-stamp indicates the order and relative timing for playing the notes. The track or channel number is used to identify a group of notes that are intended for a specific instrument or musical function such as a melodic line. For instance, one track may be associated with the piano part, another track the bass part, and another track the strings part, etc. A musical section includes a chord progression that the musical notes of the musical style are played against.

The performance engine 16, generates a musical sequence (also referred to herein as a sequence of performance notes) based on the input of a musical style and a chord progression in the musical section. The musical sequence identifies the notes to be played by a musical device driven by the performance engine 16. For instance, the musical sequence may contain data to be provided to a musical device through an instrument interface 39 such as a Musical Instrument Digital Interface (MIDI).

During a performance, one of the functions of the performance engine 16, or a similar performance component in a comparable system, is to adjust the pitch of the notes based on the chords of the chord progression that they are being played against. In musical terminology, the notes of each musical track are transposed or mapped to a different pitch when played against various chords. Current techniques allow for the notes of a style to be mapped against a single chord. However, in some instances, it is desirable for notes associated with different tracks to be mapped against different chords. If multiple chords are simultaneously played during a musical performance, this technique would allow the notes to have independent, complex harmonic movements. With complex harmonic movements, the notes of each track in a musical style can be played against a different chord and follow a different chord progression. This results in producing richer harmonic value in the musical performance. However, providing this capability increases the complexity of mapping the notes of a track to the chords in the progression. Thus, there is a need for a system and a method for independently mapping the notes of one or more tracks of a musical style against the chords of a multiple chord progressions.

In some circumstances, it is desirable for the notes associated with one track of a musical style to be mapped against a chord in a different manner than the notes associated with other tracks. For instance, if one track contains notes representing a drum part, then typically, the notes should not be transposed over the course of the chord progression. Transposing the notes of a drum part, for instance, may result in changing a snare drum note into a bongo. Thus, each of the notes of the drum part should be played as their original value. However, if a second track contains a piano accompaniment, it is desirable to transpose the notes of this track to different keys over the course of a chord progression.

Various algorithms or techniques can be used when transposing the notes of a musical style. In the systems defining the current state of the art, the flexibility in mapping the notes of a musical style in various methods are limited. For instance, melodic lines such as the bass part, do not sound proper when mapped to a complex chord that is not defined in equal intervals. However, if the bass part could be mapped to the chord in one manner, while the other tracks are mapped in a different manner, the overall sound of the musical performance can be improved. Thus, there is a need in the art for a system and a method that allows each track of a musical style to be individually associated with a mapping technique.

During a single musical performance, it is desirable to modify the mood or Personality of the musical performance. Generally, these modifications may require a change in the mapping technique of a series of notes within a track. Thus, there is a need in the art for a system and a method that allows groups of notes or even single notes to be individually associated with a mapping technique.

Therefore, there may be seen a need in the art for a system and method for mapping the notes of a musical section against multiple chords and for individual tracks, groups of notes and notes of a musical section to be individually associated with a mapping technique.

SUMMARY OF THE INVENTION

The present invention provides a system and a method for generating performance notes or musical notes from musical data received from a source. A first aspect of the present invention advantageously allows the notes of one or more tracks of a musical style to be mapped or transposed against different chords of a polychord progression. A second aspect of the present invention provides a system and a method for individual tracks, groups of notes, or single notes to be associated with a mapping or transposing technique. These two aspects of the present invention advantageously allow a higher quality musical performance to be generated.

An embodiment of the first aspect of the present invention provides a system and a method for generating performance notes or musical notes from musical data received from a composing source. In this embodiment, the musical data includes a series of musical notes with each musical note being associated with a musical track. Furthermore, each musical track is associated with a chord function selected from a domain of one or more chord functions. Initially, a polychord definition is received from the composing source. The polychord definition identifies one or more member chords with each member chord being associated with at least one of the chord functions in the domain of chord functions. In an exemplary embodiment, the domain of chord functions includes Y chord functions and each polychord includes X member chords where Y and X are positive integers and Y is equal to or greater than X. Each of the Y chord functions are associated with only one of the X member chords. Each of the X member chords are associated with one or more of the Y chord functions. Next, a controlling member chord is identified for each track. The controlling member chord is identified by determining which member chord is associated with the same chord function as the musical track. Finally, performance notes are generated for each note of each track. This is accomplished by transposing each note as a function of the controlling member chord of the track including the note. Thus, this aspect of the present invention allows the notes of each track to be independently transposed against different chords of a polychord progression.

An embodiment of the second aspect of the present invention provides a system and a method for transposing notes based on one of a plurality of selectable playback modes. Initially, a chord definition is received from a source. The chord definition includes a scale root, a scale pattern, a chord root and a chord pattern. Next, a note and a playback mode associated with the note is received from the source. The pitch of the note is represented by an encoded value defining an octave position, a chord position, a scale position, and an accidental position. Finally, the note is transposed as a function of the chord and the playback mode. Several playback modes are defined herein, however, the present invention should not be limited to the particular playback modes defined. In addition, the notes received from the source are associated with a musical track. The musical track can also be associated with a playback mode. In one embodiment, if a note does not identify a valid playback mode, the playback mode associated with the note's track may be used. Thus, this aspect of the present invention allows tracks, groups of notes, and individual notes to be independently associated with a playback mode.

These and other aspects, features, and advantages of the present invention will be more clearly understood and appreciated from a review of the following detailed description of the present invention and possible embodiments thereof, and by reference to the appended drawings and claims.

DETAILED DESCRIPTION

Figure 1:
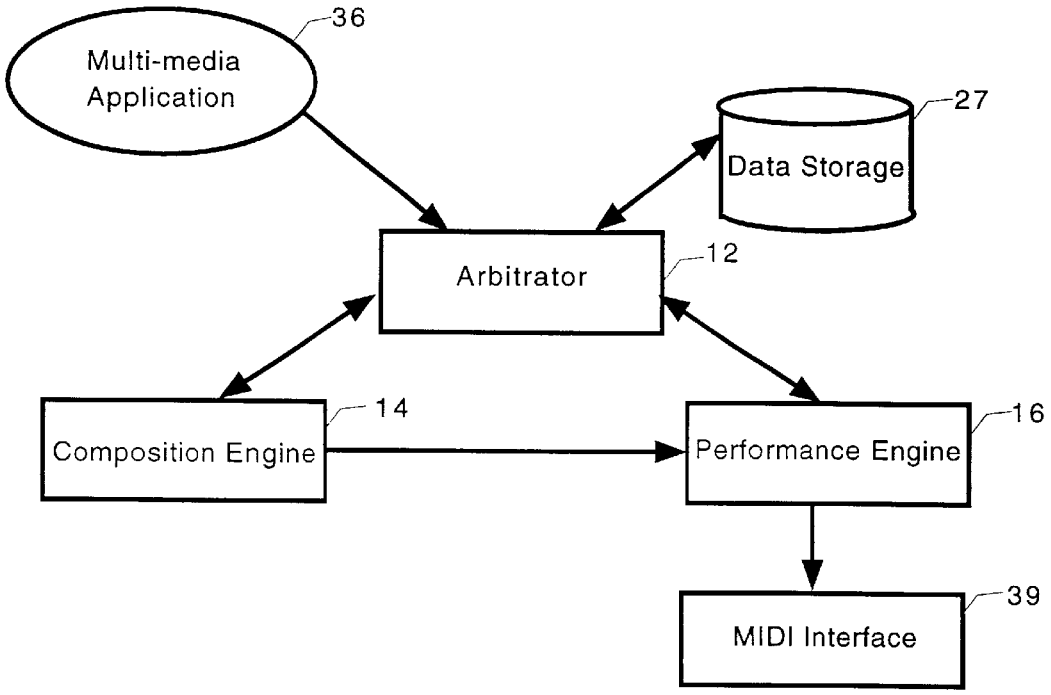
FIG. 1 is a block diagram illustrating a general architecture of a music generating system.

The present invention is directed toward improving the musical quality of a computer based musical performance. More specifically, the present invention provides enhanced capabilities in converting and processing musical data, including chord progressions and notes received from a composing source, into the musical notes making up a musical performance. The enhanced capabilities provided by the present invention improve the quality and richness of the musical performance as perceived by a listener. As previously described in reference to FIG. 1, an exemplary system architecture embodying the present invention can be described as including the functional components of: an arbitrator 12; a composition engine 14; a performance engine 16; an instrument interface 39; and data storage 27.

In reference to this exemplary system architecture, aspects of the present invention include improvements to the performance engine 16. Although the aspects of the present invention are generally described in reference to this exemplary system architecture, the present invention is also applicable in other comparable system architectures that include the equivalence of a performance component which generates a musical sequence by mapping or transposing notes against chords of a chord progression.

Generally, the present invention provides enhancements to the performance engine component of the exemplary architecture by: (1) providing complex harmonic movements; and (2) providing multiple playback modes. The first aspect of this invention provides a system and a method for notes of a track to move in a separate harmonic progression from the notes of other tracks. This is generally accomplished by mapping the notes of each track to different chords. The second aspect of this invention provides a system and a method for individual tracks, groups of notes or single notes to be assigned to one of several playback modes. Thus, these various portions can be mapped against chords in a manner dependent upon the assigned playback mode.

Referring now to the drawings, in which like numerals represent like elements through the several figures, these aspects of the present invention and the preferred operating environment will be described.

Exemplary Operating Environment

Figure 2:
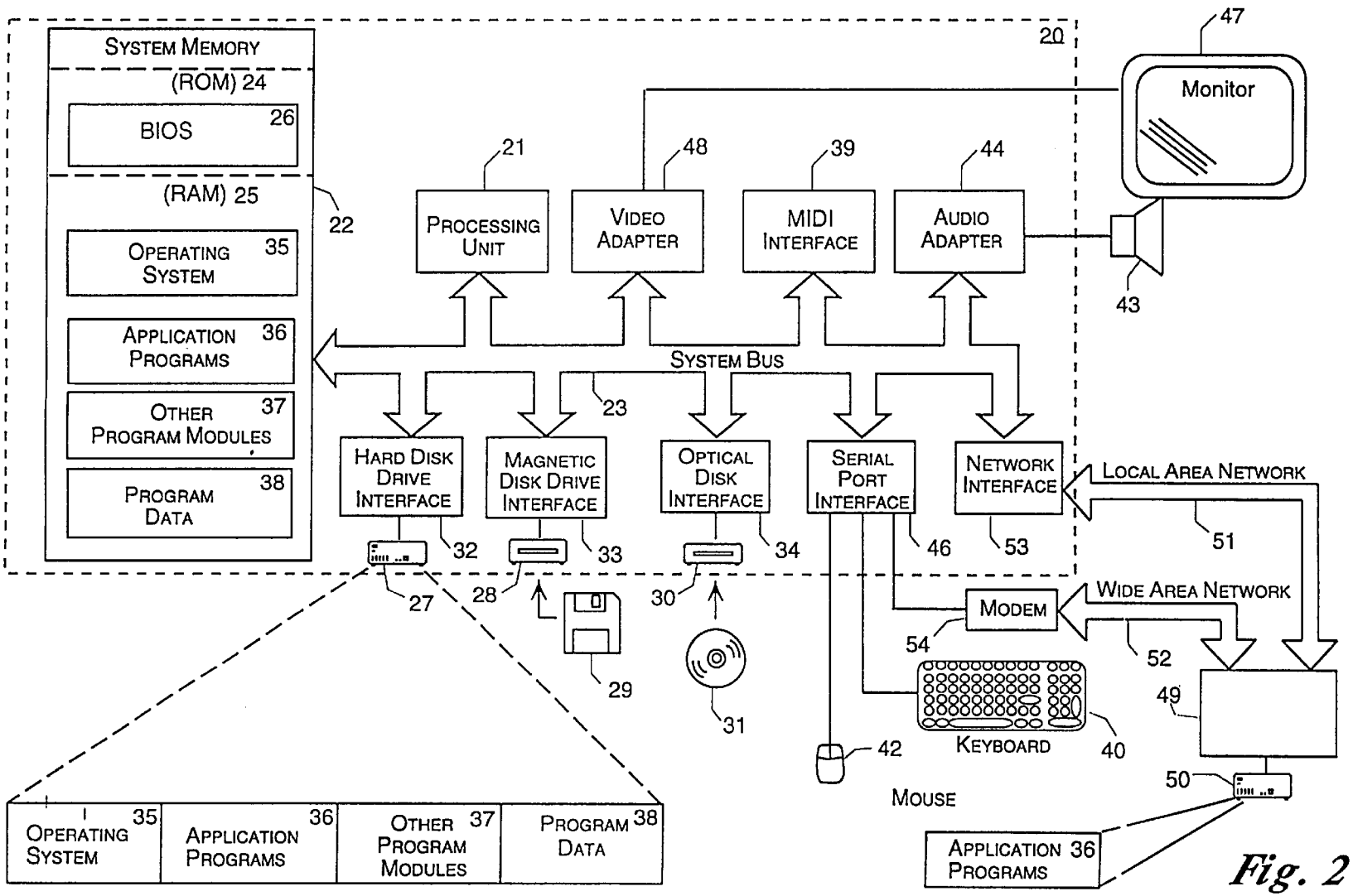
FIG. 2 is a system diagram that illustrates an exemplary environment suitable for implementing embodiments of the present invention.

FIG. 2 is a system diagram that illustrates an exemplary environment suitable for implementing embodiments of the present invention. FIG. 2 and the following discussion are intended to provide a brief, general description of a suitable computing environment in which the invention may be implemented. While the invention will be described in the general context of an application program that runs on an operating system in conjunction with a personal computer, those skilled in the art will recognize that the invention also may be implemented in combination with other program modules or application programs as well as a combination of interacting hardware and software components.

Generally, program modules include routines, programs, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

The exemplary system illustrated in FIG. 2, includes a conventional personal computer 20, including a processing unit 21, system memory 22, and a system bus 23 that couples the system memory to the processing unit 21. The system memory 22 includes read only memory (ROM) 24 and random access memory (RAM) 25. The ROM 24 provides storage for a basic input/output system 26 (BIOS), containing the basic routines that help to transfer information between elements within the personal computer 20, such as during start-up. The personal computer 20 further includes a hard disk drive 27, a magnetic disk drive 28 for the purpose of reading from or writing to a removable disk 29, and an optical disk drive 30 for the purpose of reading a CD-ROM disk 31 or to read from or write to other optical media. The hard disk drive 27, magnetic disk drive 28, and optical disk drive 30 interface to the system bus 23 through a hard disk drive interface 32, a magnetic disk drive interface 33, and an optical drive interface 34, respectively. The drives and their associated computer-readable media provide nonvolatile storage for the personal computer 20. Although the description of computer-readable media above refers to a hard disk, a removable magnetic disk and a CD-ROM disk, it should be appreciated by those skilled in the art that other types of media which are readable by a computer, such as magnetic cassettes, flash memory cards, digital video disks, Bernoulli cartridges, and the like, may also be used in the exemplary operating environment.

A number of program modules may be stored in the drives 27–30 and RAM 25, including an operating system 35, one or more application programs 36, other program modules 37, and program data 38. A user may enter commands and information into the personal computer 20 through a keyboard 40 and pointing device, such as a mouse 42. Other input devices (not shown) may include a microphone, joystick, track ball, light pen, game pad, scanner, camera, or the like. These and other input devices are often connected to the processing unit 21 through a serial port interface 46 that is coupled to the system bus, but may be connected by other interfaces, such as a game port or a universal serial bus (USB). A computer monitor 47 or other type of display device is also connected to the system bus 23 via an interface, such as a video adapter 48. One or more speakers 43 are connected to the system bus via an interface, such as an audio adapter 44. In addition to the monitor and speakers, personal computers typically include other peripheral output devices (not shown), such a printers and plotters.

The personal computer 20 includes a musical instrument digital interface ("MIDI") adapter 39 that provides a means for the PU 21 to control a variety of MIDI compatible devices (i.e., electronic keyboards, synthesizers, etc.) as well as receive MIDI events from the same. The MIDI adapter operates by receiving data over the system bus 23, formatting the data in accordance with the MIDI protocol, and transmitting the data over a MIDI bus 45. The equipment attached to the MIDI bus will detect the transmission of the MIDI formatted data and determine if the data is to be accepted and processed or ignored.

The personal computer 20 may operate in a networked environment using logical connections to one or more remote computers, such as a remote computer 49. The remote computer 49 may be a server, a router, a peer device or other common network node, and typically includes many or all of the elements described relative to the personal computer 20, although only a memory storage device 50 has been illustrated in FIG. 2. The logical connections depicted in FIG. 2 include a local area network (LAN) 51 and a wide area network (WAN) 52. These types of networking environments are commonplace in offices, enterprise-wide computer networks, intranets and the Internet.

When used in a LAN networking environment, the personal computer 20 is connected to the LAN 51 through a network interface 53. When used in a WAN networking environment, the personal computer 20 typically includes a modem 54 or other means for establishing communications over the WAN 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Multiple Chords for Complex Harmonic Movement

Figure 3:
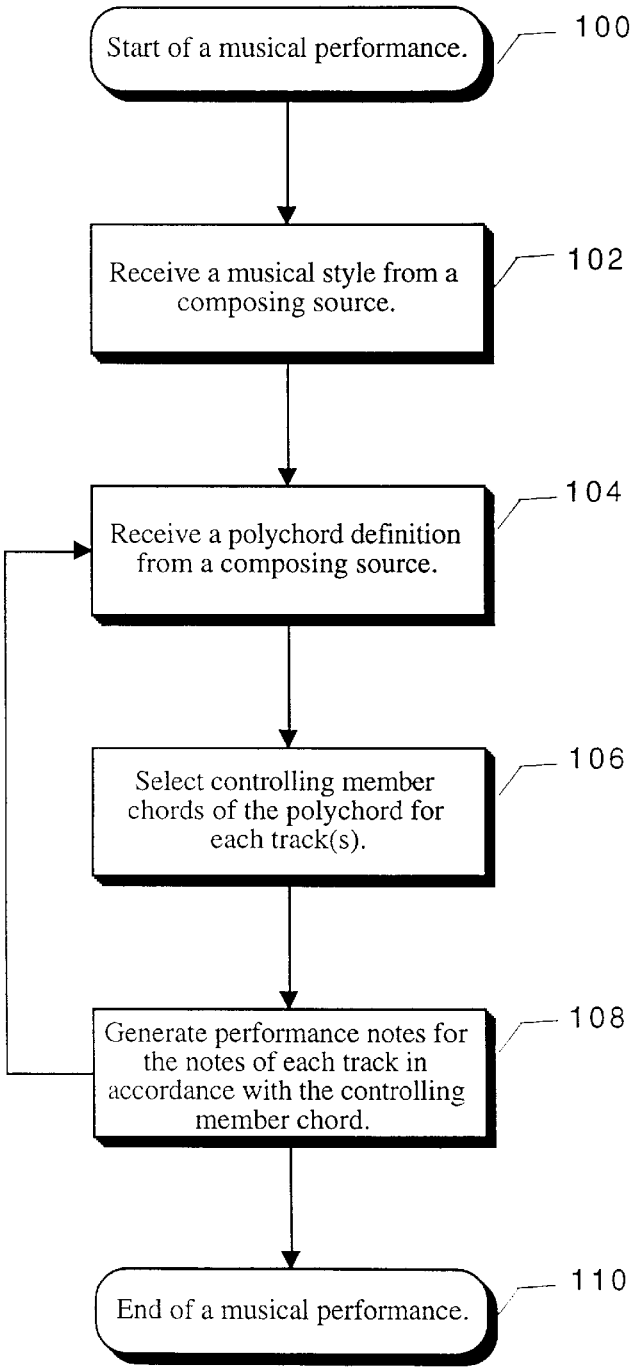
FIG. 3 is a flow diagram illustrating the steps involved in providing complex harmonic movement in an exemplary embodiment of the present invention.
Figure 4:
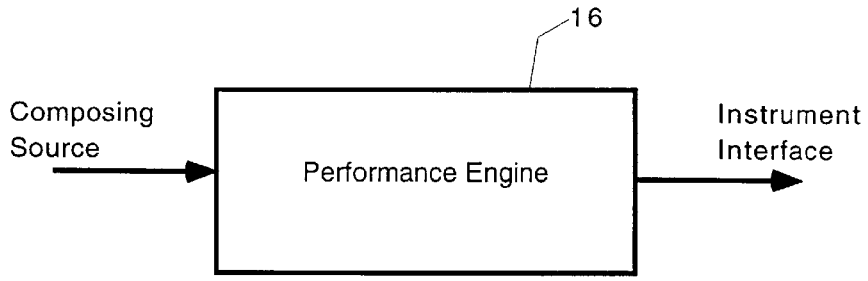
FIG. 4 is a block diagram illustrating the context in which the steps of FIG. 3 may be performed.

The first aspect of this invention provides a system and a method for notes associated with one track to move harmonically separate from the notes associated with other tracks when the notes are played against the chords of a chord progression. This is generally accomplished by providing a method for mapping the notes of each track to different chords. FIG. 3 is a flow diagram illustrating the steps involved in providing complex harmonic movement. FIG. 4 is a block diagram illustrating the context in which the steps of FIG. 3 are performed. At step 100, a musical performance begins. At step 102, the performance engine 14 receives musical data or data formatted into a musical style from a composing source. The composing source may be a live composer operating in conjunction with a user interface, a computer based composing device generating musical data in response to a variety of input signals and information, a play back of pre-recorded musical data or the like. In addition, the actual structure of the musical style is arbitrary and the present invention is not limited to any particular data structure, data format, or protocol.

A musical style is a collection of information that, among other things, identifies a series of time-stamped notes and performance parameters that effect the manner in which the notes are performed. In general, each note is associated with a musical track. Furthermore, the pitch of each note may be represented by an encoded value, a fixed value, or a combination of both. In addition, the musical style defines a chord function that is associated with each track. As will be described in more detail later, the chord function is used to identify a chord that the notes of the track are to be mapped against. By default, each track is associated with a default chord function if one is not provided by the composing source or the musical style. Each note of a track will be transposed against the chord identified by the chord function associated with the track; however, a mechanism is also provided whereby each individual note of a track can identify a chord function and override the track's chord function. In this case, each note of a track may include memory space to store a chord function.

Figure 5:
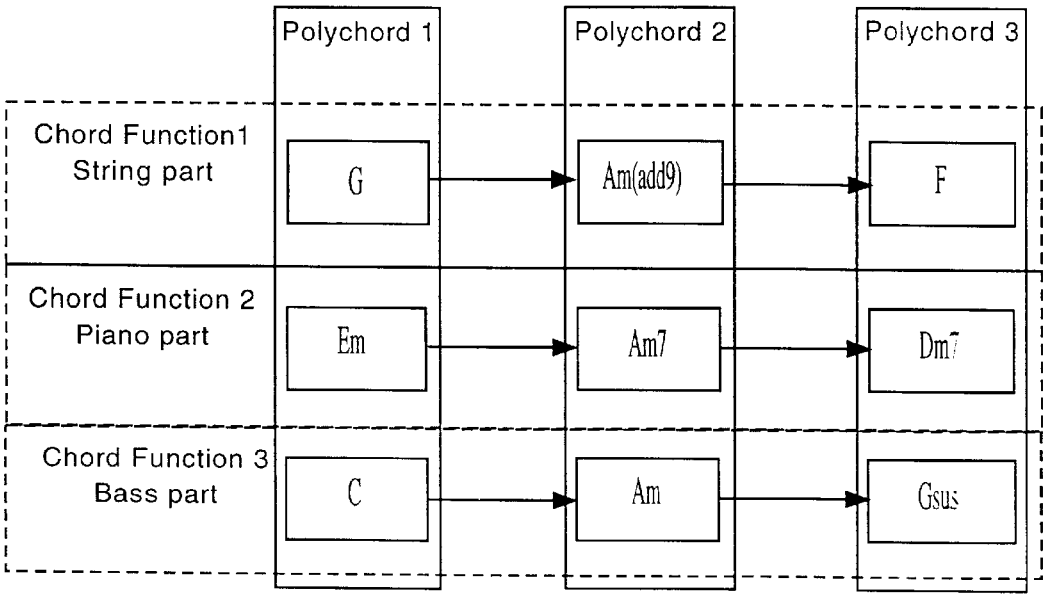
FIG. 5 is a diagram illustrating the chords of several polychords and the assignment of chord functions to each chord.

At step 104, a polychord definition is received from the composing source. A polychord is a group of one or more chords (or member chords) that may or may not contain common notes. For example, the sub-chords C Major, Em, and G Major can be defined in a single polychord. The composing source is at complete liberty in defining the polychords. Thus, the composing source may enter a sophisticated progression of polychord definitions containing multiple chords or a very simple progression of polychord definitions with each polychord containing only a single chord. Additionally, several sophisticated and simple progressions can be linked together over a musical progression. FIG. 5 is a graphical illustration of a three polychord progression. In this progression, polychord 1 consists of the chords G, Em and C; polychord 2 consists of the chords Am(add 9), Am7 and Am; and polychord 3 consists of the chords F, Dm7 and Gsus.

The collection of all possible chord functions make up the domain of chord functions. The domain of chord functions may be inherent to the music generation system or may be provided from an external source. Each chord of a polychord definition identifies one or more chord functions from the domain of chord functions. In total, the sum of the chords in a polychord must identify the entire domain of chord functions, with each chord identifying a mutually exclusive subset of the domain. An exemplary system provides support for up to 32 chord functions; however, the actual number of chord functions is arbitrary and the present invention is not limited to any specific number of chord functions.

In the most general sense, the chord functions provide a mechanism for identifying which chord of a polychord is to be used for each track of a musical style. Thus, the chord functions can be arbitrary or, in various embodiments, specific functions can be identified by the chord functions. For instance, in the embodiment illustrated in FIG. 5, three chord functions are defined including: Chord Function 1=string part; Chord Function 2=piano part; and Chord Function 3=bass part. Alternatively, the chord functions can be independent from any specific musical parts. In addition, a track associated with the bass part of a musical performance could be assigned to a chord function associated with the piano part.

Each track of a musical style may be associated with only one chord function. In sophisticated styles, each track may be associated with a unique chord function. In less sophisticated styles, multiple tracks may be associated with the same chord function. Finally, in the most simplistic case, every track within a style is associated with the same chord function.

Returning to FIG. 3, at step 106, for each track in the style, a controlling member chord or the chord of a polychord that is associated with that track is determined by: (1) identifying the chord function associated with each track; and (2) identifying the chord functions associated with each of the chords of the polychord; and (3) selecting the chord of the polychord that is associated with the same chord function as the track as the controlling member chord.

At step 108, each of the notes of the track are then mapped against the chord selected in step 106 until the next polychord is received at step 104. The notes can be mapped against the chord in a variety of techniques. The second aspect of the present invention address these techniques. This process continues until the last note of a track is processed and the musical performance ends at step 110.

Multiple Playback Modes

The second aspect of this invention provides a system and a method for individual tracks, groups of notes, or single notes to be assigned to one of several playback modes. Thus, various portions of the tracks of a musical style can be mapped against chords in a manner dependent upon the assigned playback mode. This aspect of the invention advantageously allows the notes of one track to be mapped against a chord progression in the most musically appropriate manner without limiting or constraining the operation of the performance engine in mapping the notes of other tracks. Thus, the drum part of a musical style and the melodic portion of a musical style can be mapped against the chord progression in the most musically appropriate manner.

Figure 6:
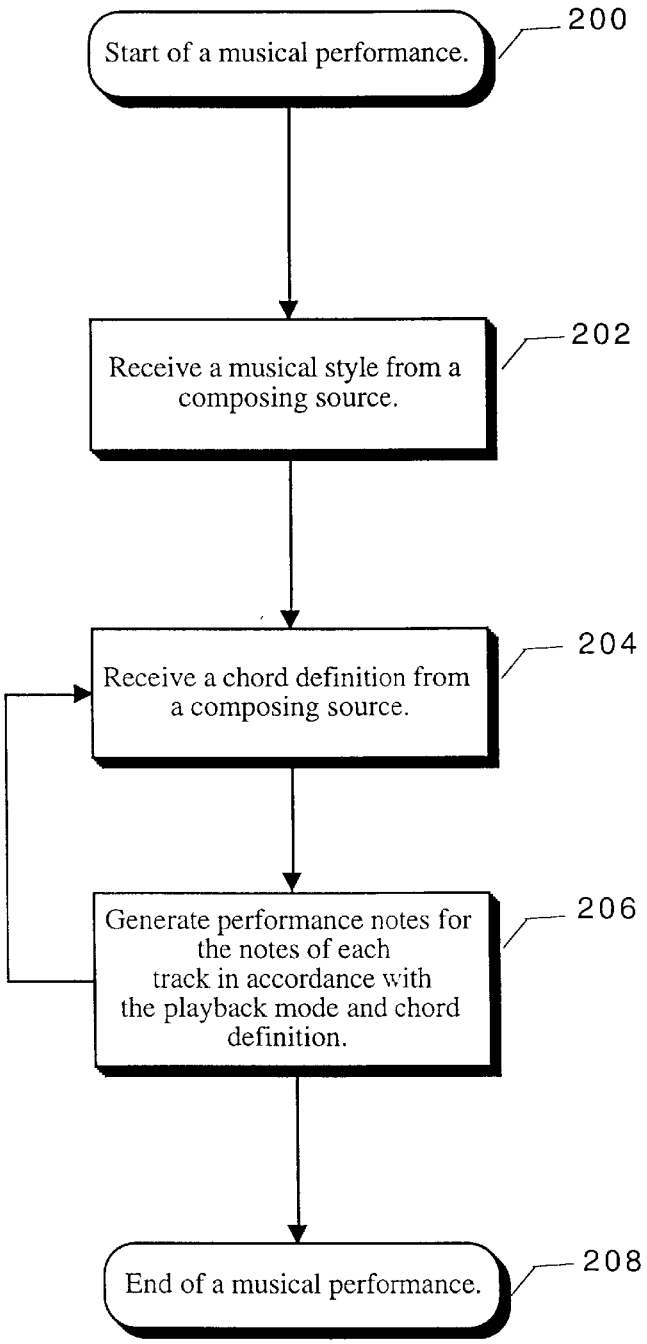
FIG. 6 is flow diagram illustrating the steps involved in providing multiple playback modes in an exemplary embodiment of the present invention.

FIG. 6 is flow diagram illustrating the steps involved in providing multiple playback modes. FIG. 4 is a block diagram illustrating the context in which these steps are performed. At step 200, a musical performance begins. At step 202, the performance engine 16 receives a musical style from a composing source. Again, the composing source may be a live composer operating in conjunction with a user interface, a computer based composing device generating musical data in response to a variety of input signals and information, a play back of pre-recorded musical data or the like. In addition, the actual structure of the musical style is arbitrary and the present invention is not limited to any particular data structure, data format, or protocol.

The musical style necessary for this aspect of the present invention, includes a series of notes with each note being associated with one track and identifying a playback mode. In addition, the musical style can identify a default playback mode for each track. The default playback mode is to be used if a note does not identify a valid playback mode. Thus, each track has a default playback mode with the playback mode of the individual notes taking precedence over the default playback mode.

At step 204, the performance engine 16 receives a chord definition. In an exemplary embodiment, the chord definition includes: (1) the chord root; (2) the chord pattern; (3) the scale root; and (4) the scale pattern. Those skilled in the art will recognize the musical significance of each of these components and how they are related to each other. In an example described herein below, specific definitions of these terms in relationship to the described example will be provided.

At step 206, performance notes are generated for each of the notes based on the appropriate playback mode and the chord definition. The process of step 206 continues until processing either returns to step 204 to receive a next chord definition, or the musical performance is ended at step 208.

Figure 7:
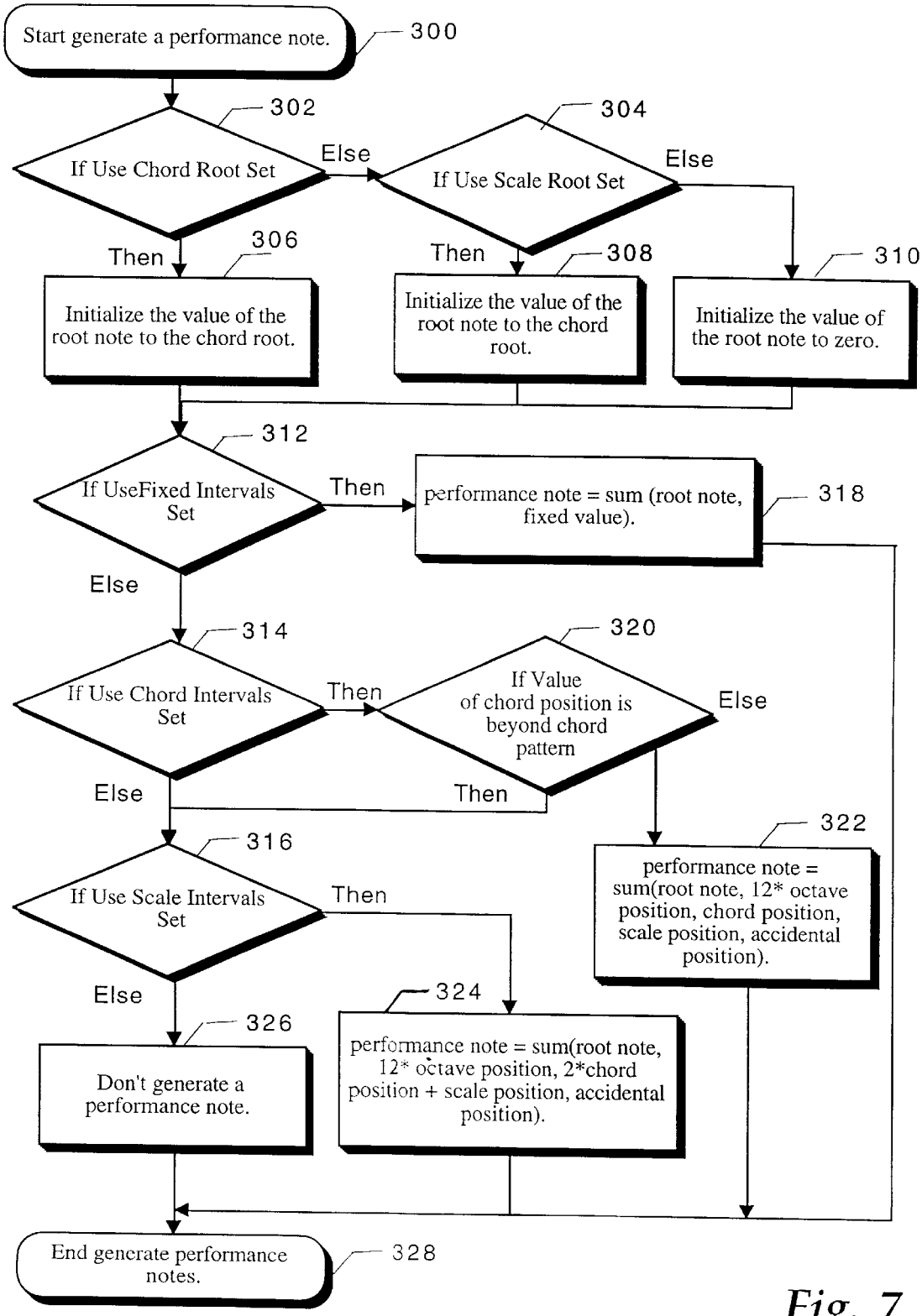
FIG. 7 is a flow diagram illustrating further details in the process of generating performance notes from encoded values (step 206 of FIG. 6).

FIG. 7 is a flow diagram illustrating further details of the process of generating performance notes (step 206 of FIG. 6). In an exemplary embodiment of this aspect of the present invention, each of the notes in the style can be expressed in two methods. In the first method the note is expressed as an encoded value that includes at least four parameters: octave position, chord position, scale position, and accidental position. These four parameters represent the "musical value" of the note and may be represented in the format O-C-S-A. The octave position parameter identifies the octave in which the note belongs. The chord position parameter identifies the interval of the currently played chord that the note belongs. If the note does not directly correspond with one of the chord intervals, the scale position parameter identifies an offset, within the scale, that the note exists from the chord interval identified by the chord position. If the note does not directly correspond with one of the scale positions, the accidental position parameter identifies an offset beyond scale position that the note exists. The second method uses a fixed value, such as a MIDI pitch, to represent the note.

The playback mode for each note or track identifies the particular technique to use when mapping the note against a chord. A key component of this aspect of the invention is providing the ability to identify playback modes for individual notes and then to use one of several transposing techniques based on the playback mode. In the exemplary embodiment, seven playback modes are provided. Although the present invention will be described in the context of providing these seven playback modes, it will be appreciated that the concepts and operations of the present invention can easily be expanded to include additional playback modes. Thus, providing the following examples and explanations of the seven playback modes in the exemplary system is for illustrative purposes only and does not limit the present invention in any manner.

In the exemplary embodiment, the playback modes are identified by using a field of five logical flags: use scale root, use chord root, use scale intervals, use chord intervals, and use fixed intervals. Each of the seven playback modes of the exemplary embodiment correspond with a unique state of the logical flags. These seven modes and the corresponding state of the logical flags are provided below in Table 1. Additional logical flags and combinations of logical flags can easily be added to provide additional playback modes.

TABLE 1

| Playback Mode | Logical Flags Set to Select Playback Mode |
|---|---|
| fixed | use fixed intervals |
| fixed to key root | use fixed intervals, use scale root |
| fixed to chord root | use fixed intervals, use chord root |
| pedal-point | use scale intervals, use scale root |
| melodic | use scale intervals, use chord root |
| normal chord | use chord intervals, use chord root |
| chord/scale | use scale intervals, use chord intervals, use chord root |

In the fixed playback mode, the fixed value of the note is always played without being transposed (i.e., the O-C-S-A information in the note is ignored). Thus, if the fixed value contains a MIDI note, then this note is played as is without any transpositions. This playback mode is typically used for playing drum parts.

In the fixed to key root mode, the fixed value of the note is modified by the value of the scale root provided in the chord definition. The chord and scale intervals are ignored and the notes are transposed as the scale moves or changes. For instance, if the scale changes, a note that is N semitones from the root of the original scale will be transposed by playing a note that is N semitones from the new scale root.

In the fixed to chord root playback mode, the fixed value of the note is modified by the value of the chord root provided in the chord definition. In this mode, the chord and scale intervals are ignored and the notes are transposed as the chord changes. Thus, if the chord changes, a note that is N semitones from the root of the original chord will be transposed by playing the note that is N semitones from the root of the new chord.

In the melodic mode, the pitch of the performance note is based on the octave position, scale position, and accidental position provided with the encoded value of the note and the chord root provided in the chord definition. The chord position in the encoded value is converted into a number representing the scale interval corresponding with the chord position and is then added to the original scale position in the encoded value. Thus, the scale intervals are tracked and the chord intervals are ignored. The pitch of the performance note is determined by starting at the root of the chord in the octave corresponding with the octave position, moving the correct number of scale positions and then moving the correct number of accidental positions.

In the pedal-point mode, the pitch of the performance note is based on the octave position, scale position, and accidental position provided with the encoded value of the note and the scale root provided in the chord definition. The chord position in the encoded value is converted into a number representing the scale interval corresponding with the chord position and is then added to the original scale position in the encoded value. Thus, the scale intervals are tracked and the chord intervals are ignored. The pitch of the performance note is determined by starting at the root of the scale in the octave corresponding with the octave position, moving the correct number of scale positions and then moving the correct number of accidental positions.

In the normal chord mode, the pitch of the performance note is based on the octave position, chord position, scale position, and accidental position provided with the encoded value of the note and the chord root provided in the chord definition. Thus, the chord and scale intervals are tracked. The pitch of the performance note is determined by starting at the root of the chord in the octave corresponding with the octave position, moving the correct number of chord positions, moving the correct number of scale positions, and then moving the correct number of accidental positions.

The chord/scale mode, is a hybrid of the normal chord mode and the melodic mode. In this mode, if the chord position identified in the encoded note falls within the chord intervals provided in the chord definition, then the pitch of the performance note is determined identically to the normal chord mode. However, if the chord position does not fall within the chord intervals, then the performance note is determined in accordance with the melodic mode.

The flow diagram of FIG. 7 provides a specific example of the exemplary embodiment executing step 206 of FIG. 6. In this example, the parameters of the encoded value are based on semitone steps where a single octave consist of 12 semitones. The octave position identified in the encoded value determines which octave the note is centered about. For instance, one embodiment may assume a playable range of 10 octaves with the lowest octave identified by the integer 0 and the highest octave identified by the integer 11. In this embodiment, the first note (or the C note) of the 4th octave can be determined by multiplying the octave position by 12. This value is equal to the number of semitones that the C note of the desired octave exists from the C note of the first octave. Other embodiments could use various other methods for identifying the octave position and the present invention is easily adaptable to any such method.

In this example, the chord root provided in the chord definition represents a semitone offset that the root note, or the lowest interval, of the chord is located from the C note of the identified octave. In one embodiment, the chord position may be a positive number indicating that the root note of the chord is either within or beyond the identified octave. In another embodiment, the chord position may be a positive or a negative number. In this embodiment, a positive number indicates that the root note of the chord is located within or beyond the identified octave and a negative number indicates that the root note of the chord is located below the identified octave. Similarly, the scale root identifies a semitone offset from the first note of the identified octave where the root note of the scale begins.

Each chord interval and scale interval in this example represents a semitone offset from the root of the chord or the root of the scale respectively. For instance, a C chord played against a major scale would have a root note value of 0, a first interval of 4 (4 semitones from the root) and a second interval of 7 (7 semitones from the root). The major scale would have a root value of 0 and intervals having the values of 2, 4, 5, 7, 9, and 11.

The chord position identified in the encoded value in this example, indicates one of the chord intervals identified in the chord definition. Thus, in a chord definition providing a four note chord with evenly spaced intervals, the chord position can be equated to the integer values of 0, 1, 2, or 3 corresponding with one of the chord intervals.

The scale position identified in the encoded value in this example, indicates one of the scale intervals identified in the chord definition. Thus, in the major scale described above, the scale position can be equated to the integer values of 0–7 corresponding with one of the scale intervals.

Finally, the accidental position identified in the encoded value in this example, indicates a single semitone offset of 1 for a sharp, an offset of 2 for a double sharp, and offset of −1 for a flat or an offset of −2 for a double flat.

Those skilled in the art will recognize that the specific definitions and techniques provided in conjunction with this example are only one of many methods that can be used for encoding musical notes and defining musical chords. Although the present invention is described in embodiments using these specific definitions and techniques, other methods could also be used.

Step 300 illustrates the start point for generating a performance note for a note being played against a particular chord and having a particular playback mode. The first stage of this process is to initialize a variable (root note) to the appropriate value based on the playback mode. At step 302, if the use chord root flag of the playback mode is set, then processing continues at step 306 where the root note variable is set to the value of the chord root identified in the chord definition. Otherwise, processing continues at step 304. At step 304, if the use scale root flag of the playback mode is set, then processing continues at step 308 where the root note variable is set to the value of the scale root in the chord definition. Otherwise, processing continues at step 310. At step 310, the root note variable is set to zero. In each of these cases, processing then continues at step 312 with the root note variable having been initialized based on the playback mode.

The next stage of this process is to determine the intervals used in generating the performance notes. At step 312, if the used fixed intervals flag of the playback mode is set, then processing continues at step 318. Thus, step 318 is performed when the playback mode identifies either the fixed, fixed to scale, or fixed to chord modes. If the fixed mode is selected, then the root note variable is zero and the performance note is equated to the fixed value provided with the note. If the fixed to scale mode is selected, then the root note is equal to the scale root. In this mode, the performance note is equated to the sum of the fixed value provided with the note and the scale root identified in the chord definition. Finally, if the fixed to chord mode is selected, then the root note is equal to the chord root. In this mode, the performance note is equated to the sum of the fixed value provided with the note and the chord root identified in the chord definition. Processing then concludes at step 328.

At step 312, if the used fixed intervals flag of the playback mode is not set, then processing continues at step 314. At step 314, if the use chord intervals flag of the playback mode is set, processing continues at step 320. Thus, step 320 is performed when the playback mode identifies either the normal chord mode or the chord/scale mode. At step 320, these two modes are differentiated by determining if the chord position identified in the encoded value is within the chord intervals provided in the chord definition. If this condition is true, then the playback mode may be the chord/scale mode and processing continues at step 316. If this condition is not true, then the playback mode identifies the normal chord mode and processing continues at step 322.

At step 322 (normal chord mode), the performance note is equated to sum of the root note variable, the octave position multiplied by 12, the value of the chord interval identified by the chord position, the value of the scale interval identified by the scale position, and the value of the accidental position. The reader may observe that a playback mode with the use scale root flag and the use chord intervals flag set would also result in invoking step 322. In addition, a playback mode with the use chord intervals and the use scale intervals flags set where the chord position is within the chord intervals provided in the chord definition would result in invoking step 322. However, in the example provided, these particular playback modes are not defined. In alternative embodiments, these playback modes can be defined allowing the performance note to be determined in different manners. In addition, other flags could be used to identify further playback modes.

At step 314, if the use chord intervals flag of the playback mode is set, then processing continues at step 316. At step 316, if the use scale intervals flag is set, processing continues at step 324. Thus, step 324 is performed if: the use scale intervals and the use scale root flags are set (pedal-point mode); the use scale intervals and the use chord root flags are set (melodic mode); or the use scale intervals and use chord intervals flags are set and the value of the chord position is beyond the chord intervals provided in the chord definition (chord/scale mode).

At step 324, the performance note is equated to the sum of the root note variable, the octave position multiplied by 12, the value of the scale interval identified by the sum of the scale position and two times the chord position, and the value of the accidental position.

Finally, at step 316, if the use scale intervals flag of the playback mode is not set, then a performance note is not generated. This may result under two conditions. In the first condition, the playback mode is set to an invalid value (i.e., neither the use fixed intervals, use chord intervals, nor the use scale intervals flags are set). In the second condition, the use chord intervals flag is set, the chord position is beyond the chord intervals identified in the chord definition and the use scale intervals flag (enabling the chord/scale mode) is not set. The process of generating a performance note then concludes at step 328.

Example of Exemplary Embodiment

Figure 8:
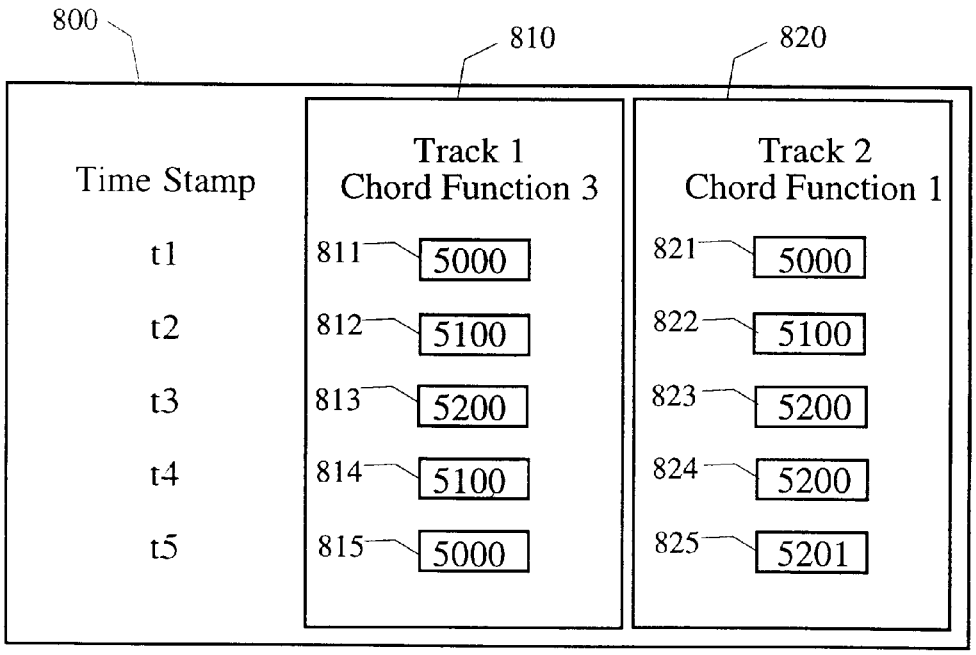
FIG. 8 is a diagram illustrating an example of the operation of an exemplary embodiment of the present invention.
Figure 8:
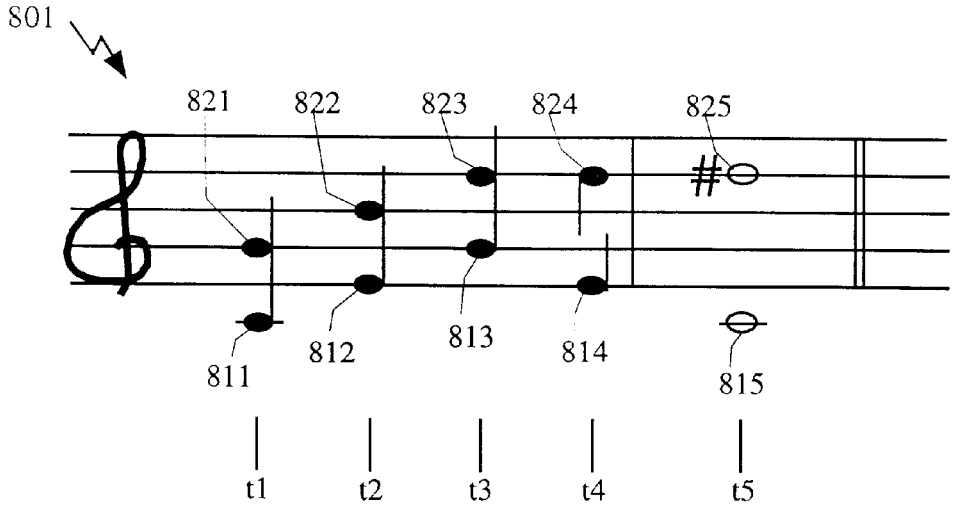

FIG. 8 is a diagram illustrating an example of the operation of AN exemplary embodiment of the present invention. A chart 800 list information for two tracks: track 1 810 and track 2 820. Track 1 810 includes a sequence of five encoded notes 811–815 (using the O-C-S-A format) with each note being assigned to the normal chord playback mode. Track 1 810 is assigned to chord function 3. For illustrative purposes, chord function 3 corresponds with the bass part of polychord 1 in FIG. 5. Thus, the encoded notes 811-815 of track 1 810 are played against the C chord in a major scale. Track 2 820 includes a sequence of five encoded notes 821–825 with each note being assigned to the melodic mode. Track 2 820 is assigned to chord function 1. For illustrative purposes, chord function 1 corresponds with the string part of polychord 1 in FIG. 5. Thus, the encoded notes 821–825 of track 2 820 are played against the G chord in a major scale. The time stamps t1–t5 indicate the point in time that each of the encoded notes should be played.

Each of the encoded notes 811–815 of track 1 810 are mapped against the C chord by performing the steps of FIG. 6 and FIG. 7. The results of this process are illustrated on the staff diagram 801 of FIG. 8 above the respective time stamps. Performing the steps illustrated in FIG. 7, a performance note for the encoded note 811 is determined as follows:

(1) In the normal chord playback mode, the use chord root flag is set. Thus, at step 306, the root note is set to the chord root. For the C chord being played against a major scale, this is equal to 0.

(2) In the normal chord playback mode, the use chord intervals flag is set. At step 320, because the chord position of the encoded note is zero, the chord position is not beyond the chord pattern for a C chord. Thus, at step 322, the performance note is set to:

| | |
|---|---|
| root note | 0 |
| 12 * octave position 5 | 60 |
| chord position | 0 |
| scale position | 0 |
| accidental position | +0 |
| | 60. |

The value 60 represents a 60 semitone offset from a base note. In this embodiment, the base note is the C note of octave 0. Thus, the encoded note 811 maps to middle C when played against the C chord in a major scale.

Each of the encoded notes 821–825 of track 2 820 are mapped against the G chord by performing the steps of FIG. 6 and FIG. 7. The results of this process are illustrated on the staff diagram 801 of FIG. 8 above the respective time stamps. Performing the steps illustrated in FIG. 7, a performance note for the encoded note 821 is determined as follows:

(1) In the melodic playback mode, the use chord root flag is set. Thus, at step 306, the root note is set to the chord root. For the G chord being played against a major scale, this is equal to 7.

(2) In the melodic playback mode, the use scale intervals flag is set. Thus, at step 324, the performance note is set to:

| | |
|---|---|
| root note | 7 |
| 12 * octave position 5 | 60 |
| chord position | 0 |
| scale position | 0 |
| accidental position | +0 |
| | 67. |

The value 68 represents a 68 semitone offset from the base note. Thus, the encoded note 821 maps to the G note of the 5th octave when played against the G chord in a major scale.

The semitone offset for each of the remaining notes in FIG. 8 are determined and calculated as follows:

| encoded notes 812 and 814 | | |
|---|---|---|
| root note | 0 | |
| 12 * octave position 5 | 60 | semitones from base note |
| chord position 1 | 4 | semitones from chord root |
| scale position 0 | 0 | |
| accidental position 0 | +0 | |
| | 64; | |

-continued

| encoded note 813 | | |
|---|---|---|
| root note | 0 | |
| 12 * octave position 5 | 60 | |
| chord position 2 | 7 | semitones from chord root |
| scale position 0 | 0 | |
| accidental position 0 | +0 | |
| | 67; | |

| encoded note 822 | | |
|---|---|---|
| root note | 7 | |
| 12 * octave position 5 | 60 | |
| chord position 1 | — | not applicable |
| scale position 2 (2 * chord position) | 4 | semitones from chord root |
| accidental position 0 | +0 | |
| | 71; | |

| encoded notes 823 and 824 | | |
|---|---|---|
| root note | 7 | |
| 12 * octave position 5 | 60 | |
| chord position 2 | — | not applicable |
| scale position 4 (2 * chord position) | 7 | semitones from chord root |
| accidental position 0 | +0 | |
| | 74; | and |

| encoded note 825 | | |
|---|---|---|
| root note | 7 | |
| 12 * octave position 5 | 60 | |
| chord position 2 | — | (not applicable) |
| scale position 4 (2 * chord position) | 7 | semitones from chord root |
| accidental position 0 | +1 | |
| | 75. | |

Conclusion

From the foregoing description, it will be appreciated that a first aspect of the present invention provides a system and a method for the notes of one track to move in a harmonically separate manner from the notes of another tracks when the notes of each track are played against a chord progression. Each track is associated with a chord function. The notes of the tracks are then played against a progression of polychords, where each polychord consists of one or more chords. In addition, each chord of each polychord is associated with one or more chord functions. During operation, each note of a track is mapped against a chord of the currently playing polychord. The chord for each track is selected by identifying the chord of the polychord that is associated with the same chord function as the track. Thus, the notes of each track can be mapped against different chords allowing for separate harmonic movements.

It will also be appreciated that a second aspect of the present invention provides a system and a method for individual tracks, groups of notes, or single notes to be assigned to one of several playback modes. Each note includes a field that identifies a playback mode. In addition, each track is associated with a playback mode. Prior to generating a performance note, the playback mode for the note is determined, and the note is transposed or mapped against the currently playing chord in accordance with the playback mode.

Each of these aspects of the present invention can be individually implemented or can be implemented together within a single system.

The present invention may be conveniently implemented in one or more program modules. No particular programming language has been indicated for carrying out the various tasks described above because it is considered that the operation, steps, and procedures described in the specification and illustrated in the accompanying drawings are sufficiently disclosed to permit one of ordinary skill in the art to practice the instant invention. Moreover, in view of the many different types of computers and program modules that can be used to practice the instant invention, it is not practical to provide a representative example of a computer program that would be applicable to these many different systems. Each user of a particular computer would be aware of the language and tools which are more useful for that user's needs and purposes to implement the instant invention.

The present invention has been described in relation to particular embodiments which are intended in all respects to be illustrative rather than restrictive. Those skilled in the art will understand that the principles of the present invention may be applied to, and embodied in, various program modules for execution on differing types of computers regardless of the application.

Alternative embodiments will become apparent to those skilled in the art to which the present invention pertains without departing from its spirit and scope. Accordingly, the scope of the present invention is described by the appended claims and supported by the foregoing description.

I claim:

1. A method for generating performance notes from musical data received from a composing source, the musical data including a plurality of notes defining at least one track, each track being associated with one chord function selected from a chord function domain of at least one chord function, comprising the steps of:

receiving a polychord definition from the composing source, the polychord definition identifying at least one member chord, each member chord being associated with at least one chord function selected from the chord function domain;

identifying a controlling member chord for each track, the controlling member chord being associated with the same chord function as the track; and generating a performance note for each note of each track as a function of the controlling member chord.

2. The method of claim 1, wherein the chord function domain includes Y chord functions where Y is a positive integer, and the receiving a polychord definition step comprises the steps of:

receiving X member chords, where X is a positive integer and is not greater than Y; and receiving information associating each of the Y chord functions with one of the X member chords.

3. The method of claim 1, wherein the chord function domain includes Y chord functions and the polychord definition includes X member chords, where X and Y are positive integers and Y is greater than X−1, each of the X member chords being represented by a data structure including a first data field that identifies the musical notes of the member chord and a second data field that identifies at least one of the Y chord functions, and the step of identifying the controlling member chord for a particular track comprises the step of searching the second data fields of each of the X member chords until the member chord associated with the same chord function as the particular track is identified.

4. The method of claim 1, wherein each of the plurality of notes in the musical data have a pitch, and the generating a performance note step comprises a step of transposing the pitch of the note as a function of the controlling member chord.

5. A computer-readable medium having computer-executable instructions for generating performance notes, comprising:

a first component for receiving polychord definitions from a composing source, each polychord definition including at least one member chord, each member chord being associated with at least one chord function selected from a domain of chord functions;

a second component for receiving musical data, the musical data including a plurality of notes with each note being associated with a musical track and each musical track being associated with one chord function selected from the domain of chord functions; and a generator module for selecting one of the plurality of notes, identifying a musical track associated with the selected note, identifying a particular member chord associated with the same chord function as the identified musical track, and generating a performance note by transposing the selected note against the particular the member chord.

6. A system for generating performance notes, comprising:

a processing unit;

a memory storage device;

a data interface for receiving polychord definitions and musical data from a musical source;

a program module, stored in the memory storage device for providing instructions to the processing unit;

the processing unit, responsive to the instructions of the program module, being operative to:

receive musical data including a plurality of notes from the data interface, the plurality of notes being associated with at least one musical track, each musical track being associated with one chord function selected from a domain of chord functions;

receive a polychord definition including at least one member chord, each member chord being associated with at least one chord function selected from the domain of chord functions; and until a next polychord definition is received, for each particular note of the plurality of notes, identify the particular note's musical track;

identify a controlling member chord, the controlling member chord being associated with the same chord function as the particular note's musical track, and generate a performance note by transposing the particular note as a function of the controlling member chord.

7. The system of claim 6, wherein the processing unit is further operative to:

receive the next polychord definition including at least one member chord, each member chord being associated with at least one chord function selected from the domain of chord functions; and until a subsequent polychord definition is received, for each particular note of the plurality of notes, identify the particular note's musical track;

identify a next controlling member chord, the next controlling member chord being associated with the same chord function as the particular note's musical track, and generate a performance note by transposing the particular note as a function of the next controlling member chord.

8. The system of claim 7, wherein the polychord definition includes X member chords, the next polychord definition includes Z member chords, and the domain of chord functions includes Y chord functions, where X, Y, and Z are integers and X and Z are not greater than Y.

9. The system of claim 6, wherein the polychord definition includes X member chords, the next polychord definition includes Z member chords, and the domain of chord functions includes Y chord functions, where X, Y, and Z are integers and X and Z are not greater than Y.

10. The system of claim 6, wherein the polychord definition includes X member chords, the next polychord definition includes Z member chords, and the domain of chord functions includes Y chord functions, where X, Y, and Z are integers and X and Z are equal and are not greater than Y.

11. A method for transposing notes based on one of a plurality of selectable playback modes, comprising:

receiving a chord definition from a source, the chord definition including a scale root, a scale pattern, a chord root and a chord pattern;

receiving a note from the source, the note identifying one of a plurality of playback modes; and transposing the note as a function of the chord, and the playback mode.

12. The method of claim 11, wherein the pitch of the note is represented by an encoded value that defines an octave position, a chord position, a scale position, and an accidental position, the playback mode identifies a chord mode, and the step of transposing the note comprises the step of equating the pitch of the note to the sum of:

the pitch value of the chord root;

the octave position multiplied by 12;

the difference in the pitch values between the chord interval identified by the chord position and the chord root;

the difference in the pitch values between the chord interval identified by the chord position and the scale interval identified by the scale position; and the pitch value of the accidental position.

13. The method of claim 11, wherein the pitch of the note is represented by an encoded value that defines an octave position, a chord position, a scale position, and an accidental position, the playback mode identifies a chord/scale mode and the chord position exceeds the number of chord intervals in the chord pattern, and the step of transposing the note comprises the step equating the pitch of the note to the sum of:

the pitch value of the chord root;

the octave position multiplied by 12;

the difference in the pitch values between the chord root and the scale interval identified by the sum of the scale position and two times the chord position; and the pitch value of the accidental position.

14. The method of claim 12, wherein the pitch of the note is represented by an encoded value that defines an octave position, a chord position, a scale position, and an accidental position, wherein the playback mode identifies a melodic mode, and the step of transposing the note comprises the step of equating the pitch of the note to the sum of:

the pitch value of the chord root;

the octave position multiplied by 12;

the difference in the pitch values between the chord root and the scale interval identified by the sum of the scale position and two times the chord position; and the pitch value of the accidental position.

15. The method of claim 11, wherein the pitch of the note is represented by an encoded value that defines an octave position, a chord position, a scale position, and an accidental position, the playback mode identifies a pedal-point mode, and the step of transposing the musical note comprises the step of equating the pitch of the note to the sum of:

the pitch value of the scale root;

the octave position multiplied by 12;

the difference in the pitch values between the scale root and the scale interval identified by the sum of the scale position and two times the chord position; and the pitch value of the accidental position.

16. The method of claim 11, wherein the pitch of the note is represented by a fixed value, the playback mode identifies a fixed to chord root mode, and the step of transposing the note comprises the step of equating the pitch of the note to the sum of:

the pitch value of the chord root; and the fixed value.

17. The method of claim 1, wherein the pitch of the note is represented by a fixed value, the playback mode identifies a fixed to key root mode, and the step of transposing the musical note comprises the step of equating the pitch of the note to the sum of:

the pitch value of the scale root; and the fixed value.

18. The method of claim 11, wherein the pitch of the note is represented by a fixed value, the playback mode identifies a fixed mode, and the step of transposing the note comprises the step of equating the pitch of the note to the fixed value.

19. A computer-readable medium having computer-executable instructions for transposing musical notes, comprising:

a first component for receiving a chord definition from a source, the chord definition including a scale root, a scale pattern, a chord root and a chord pattern;

a second component for receiving an encoded value from the source, the encoded value representing the pitch of a musical note by including an octave position, a chord position, a scale position, and an accidental position, and receiving a playback mode for each note;

a transposing module for transposing the musical note as a function of the chord definition and the playback mode.

20. The computer-readable medium of claim 19, wherein the playback mode is defined by five logical flags including a use scale root, use chord root, use scale intervals, use chord intervals, and use fixed intervals flags, and if only the use chord intervals and the use chord root flags are set, the transposing module performs the steps of transposing the musical note as a function of the chord root, the octave position, the chord position, the scale position and the accidental position.

21. The computer-readable medium of claim 20, wherein the transposing step further comprises the steps of:

if only the use scale intervals and use chord root flags are set, transposing the musical note as a function of the chord root, the octave position, the sum of the scale position and two times the chord position, and the accidental position; and if only the use scale intervals and use scale root flags are set, transposing the musical note as a function of the scale root, the octave position, the sum of the scale position and two times the chord position, and the accidental position.

22. The computer-readable medium of claim 20, wherein the transposing step further comprises the step of, if only the use scale intervals flag, the use chord intervals flag, and the use chord root flag are set, and if the chord position in the encoded value exceeds the number of chord intervals in the chord pattern, transposing the musical note as a function of the chord root, the octave position, the sum of the scale position and two times the chord position, and the accidental position.

23. The computer-readable medium of claim 19, wherein the playback mode is defined by five logical flags including a use scale root, use chord root, use scale intervals, use chord intervals, and use fixed intervals flags, the encoded value includes a fixed value representing the pitch of the musical note, and the transposing module comprises instructions for performing the steps of:

if only the use fixed intervals flag is set, transposing the musical note as a function of the fixed value;

if only the use fixed intervals flag and the use scale root flags are set, transposing the musical note as a function of the fixed value and the scale root; and if only the used fixed intervals flag and the use chord root flag are set, transposing the musical note as a function of the fixed value and the chord root.

24. A system for transposing a sequence of notes, comprising:

a processing unit;

a memory storage device;

a data interface for receiving chords and musical data from a musical source;

a program module, stored in the memory storage device for providing instructions to the processing unit;

the processing unit, responsive to the instructions of the program module, being operative to:

receive musical data representing at least one musical track, each musical track including a plurality of notes, each note identifying a playback mode and being represented by a fixed value and an encoded value, the encoded value including an octave position, a chord position, a scale position, and an accidental position;

receive a chord from the data interface, the chord being associated with a scale root, a scale pattern, a chord root and a chord pattern;

for each note in each musical track, determine a semitone offset as a function of the chord, the encoded value, the fixed value, and the playback mode for the note, the semitone offset representing the number of semitones the transposed pitch of the note is offset from a base note; and transpose each note by setting the pitch of the note equal the base note plus the semitone offset.

25. The system of claim 24, wherein the semitone offset for each particular note is determined by:

(a) if the playback mode for the particular note identifies a chord mode, equating the value of the semitone offset to the sum of the values of the chord root, the octave position multiplied by 12, the difference in the number of semitones between the chord interval identified by the chord position and the chord root, the difference in the number of semitones between the chord interval identified by the chord position and the scale interval identified by the scale position, and the value of the accidental position;

(b) if the playback mode for the particular note identifies a melodic mode, equating the value of the semitone offset to the sum of the values of the chord root, the octave position multiplied by 12, the difference in the number of semitones between the chord root and the scale interval identified by the sum of the values of the scale position and two times the chord position, and the accidental position;

(c) if the playback mode for the particular note identifies a pedal-point mode, equating the value of the semitone offset to the sum of the values of the scale root, the octave position multiplied by 12, the difference in the number of semitones between the chord root and the scale interval identified by the sum of the values of the scale position and two times the chord position, and the accidental position;

(d) if the playback mode for the particular note identifies a chord/scale mode and the value of the chord position is not larger than the number of intervals in the chord, equating the value of the semitone offset to the sum of the values of the chord root, the octave position multiplied by 12, the difference in the number of semitones between the chord interval identified by the chord position and the chord root, the difference in the number of semitones between the chord interval identified by the chord position and the scale interval identified by the scale position, and the accidental position;

(e) if the playback mode for the particular note identifies a chord/scale mode and the value of the chord position is larger than the number of intervals in the chord, equating the value of the semitone offset to the sum of the values of the chord root, the octave position multiplied by 12, the difference in the number of semitones between the chord root and the scale interval identified by the sum of the values of the scale position and two times the chord position, and the accidental position;

(f) if the playback mode for the particular note identifies a fixed mode, equating the value of the semitone offset to the fixed value;

(g) if the playback mode for the particular note identifies a fixed to key root mode, equating the value of the semitone offset to the sum of the values of the scale root and the fixed value; and (h) if the playback mode for the particular note identifies a fixed to chord root mode, equating the value of the semitone offset to the sum of the values of the chord root the fixed value.

26. The system of claim 24, wherein each track is associated with a default playback mode, and if the playback mode included with a particular note of a particular track does not equal a valid playback mode, the semitone offset is determined by:

(a) if the default playback mode identifies a chord mode, equating the value of the semitone offset to the sum of the values of the chord root, the octave position multiplied by 12, the difference in the number of semitones between the chord interval identified by the chord position and the chord root, the difference in the number of semitones between the chord interval identified by the chord position and the scale interval identified by the scale position, and the value of the accidental position;

(b) if the default playback mode identifies a melodic mode, equating the value of the semitone offset to the sum of the values of the chord root, the octave position multiplied by 12, the difference in the number of semitones between the chord root and the scale interval identified by the sum of the values of the scale position and two times the chord position, and the accidental position;

(c) if the default playback mode identifies a pedal-point mode, equating the value of the semitone offset to the sum of the values of the scale root, the octave position multiplied by 12, the difference in the number of semitones between the chord root and the scale interval identified by the sum of the values of the scale position and two times the chord position, and the accidental position;

(d) if the default playback mode identifies a chord/scale mode and the value of the chord position is not larger than the number of intervals in the chord, equating the value of the semitone offset to the sum of the values of the chord root, the octave position multiplied by 12, the difference in the number of semitones between the chord interval identified by the chord position and the chord root, the difference in the number of semitones between the chord interval identified by the chord position and the scale interval identified by the scale position, and the accidental position;

(e) if the default playback mode identifies a chord/scale mode and the value of the chord position is larger than the number of intervals in the chord, equating the value of the semitone offset to the sum of the values of the chord root, the octave position multiplied by 12, the difference in the number of semitones between the chord root and the scale interval identified by the sum of the values of the scale position and two times the chord position, and the accidental position;

(f) if the playback mode for the particular note identifies a fixed mode, equating the value of the semitone offset to the fixed value;

(g) if the default playback mode identifies a fixed to key root mode, equating the value of the semitone offset to the sum of the values of the scale root and the fixed value; and (h) if the default playback mode identifies a fixed to chord root mode, equating the value of the semitone offset to the sum of the values of the chord root the fixed value.

27. A method to generate musical notes from musical data received from a source, comprising the steps of:

receiving a plurality of notes defining at least one track, each track being associated with a chord function selected from a domain of chord functions, each note being associated with a playback mode;

receiving a polychord definition from a composing source, the polychord definition including at least one member chord, each member chord being associated with at least one chord function selected from the domain of chord functions;

identifying the controlling member chord for each musical track, the controlling member chord being associated with the same chord function as the musical track; and generating a musical note for each note of each track in accordance with the controlling member chord for the track and the playback mode associated with the note.

28. The method of claim 27, wherein the domain of chord functions includes Y chord functions where Y is a positive integer, and the receiving a polychord definition step comprises the steps of:

receiving X member chords, where X is a positive integer and is not greater than Y; and receiving information associating each of the Y chord functions with one of the X member chords.

29. The method of claim 27, wherein the polychord definition includes X member chords and the domain of chord functions includes Y chord functions, where X and Y are positive integers and Y is greater than X−1, each of the X member chords being represented by a data structure including a first data field that identifies the musical notes of the member chord and a second data field that identifies at least one of the Y chord functions, and the step of identifying the controlling member chord comprises the step of searching the second data fields of each of the X member chords until the particular chord function is identified.

30. The method of claim 27, wherein the controlling member chord identifies a scale root, a scale pattern, a chord root and a chord pattern, each note includes an encoded value providing an octave position, a chord position, a scale position, and an accidental position representing the pitch of the note, and the generating a musical note step comprises the steps of:

identifying the pitch of each note in each track; and transposing the musical note as a function of the controlling member chord and the playback mode.

31. The method of claim 30, wherein the playback mode identifies one of a plurality of methods for transposing musical notes against a chord progression, the step of transposing the musical note as a function of the controlling member chord and the playback mode comprises the steps of:

examining the playback mode to identify a method for transposing musical notes; and transposing the musical note against the controlling member chord using the identified method.

32. A computer-readable medium having computer-executable instructions for generating musical notes, comprising:

a first component for receiving polychord definitions from a composing source, each polychord definition including at least one member chord, each member chord being associated with at least one chord function;

a second component for receiving musical data, the musical data including a plurality musical notes represented by encoded values, each musical note being associated with a playback mode and one of a plurality of tracks, and each of the plurality of tracks being associated with a chord function;

a generator module for selecting a musical note, identifying a controlling member chord for the musical note, the controlling member chord being associated with the same chord function as the track that is associated with the musical note, and transposing the musical note as a function of the controlling member chord and the playback mode.

33. A system for generating performance notes, comprising:

a processing unit;

a memory storage device;

a data interface for receiving polychord definitions and musical data from a musical source;

a program module, stored in the memory storage device for providing instructions to the processing unit;

the processing unit, responsive to the instructions of the program module, being operative to:

receive musical data from the data interface, the musical data representing a plurality of notes, each of the plurality of notes including an encoded value, being associated with at least one musical track, and having a playback mode, each musical track being associated with one chord function and having a default playback mode;

receive a polychord definition from the data interface, the polychord definition including at least one member chord, each member chord being associated with at least one chord function, for each of the plurality of notes, identify a controlling member chord, the controlling member chord being associated with the same chord function as the musical track associated with the note, select one of a plurality of generation methods based on the playback mode associated with the note, and generate a performance note as a function of the encoded value of the note and the controlling member chord, using the selected generation method.

* * * * *